US007011158B2

(12) United States Patent
Davis et al.

(10) Patent No.: US 7,011,158 B2
(45) Date of Patent: Mar. 14, 2006

(54) METHOD AND APPARATUS FOR WELL BORE CLEANING

(76) Inventors: Jerry Lynn Davis, 7114 Baron Ridge Dr., Baytown, TX (US) 77521; Jerry W. Knoles, Sr., deceased, late of Mont Belvieu, TX (US); by Jerry Wayne Noles, Jr., legal representative, Rte. 4 Box 98A, Okemah, OK (US) 74859

( * ) Notice: Subject to any disclaimer, the term of this patent is extended or adjusted under 35 U.S.C. 154(b) by 182 days.

(21) Appl. No.: 10/655,956

(22) Filed: Sep. 5, 2003

(65) Prior Publication Data

US 2005/0051335 A1 Mar. 10, 2005

(51) Int. Cl.
*E21B 21/12* (2006.01)
*E21B 21/14* (2006.01)
*E21B 28/00* (2006.01)
*E21B 37/00* (2006.01)

(52) U.S. Cl. ..... 166/312; 166/222; 166/177.7; 175/424

(58) Field of Classification Search ..... 166/311, 166/312, 222, 223, 177.7, 244.1, 105, 107; 175/424
See application file for complete search history.

(56) References Cited

U.S. PATENT DOCUMENTS 1,279,333 A 9/1918 Green
2,018,284 A 10/1935 Schweitzer et al.
2,735,794 A * 2/1956 Pletcher ..... 134/24
2,771,141 A 11/1956 Lewis
3,744,723 A * 7/1973 Davis ..... 239/543
3,844,362 A 10/1974 Elbert et al.
3,912,173 A 10/1975 Robichaux
4,819,314 A * 4/1989 Shaddock ..... 29/890.01
5,179,753 A * 1/1993 Flaherty et al. ..... 15/104.12
5,195,585 A * 3/1993 Clemens et al. ..... 166/222
5,588,171 A 12/1996 Hamann
5,862,568 A 1/1999 Sjoberg
5,992,432 A * 11/1999 Horger et al. ..... 134/167 C
6,173,771 B1 * 1/2001 Eslinger et al. ..... 166/173
6,189,618 B1 2/2001 Beeman et al.
6,401,820 B1 * 6/2002 Kirk et al. ..... 166/311
6,453,996 B1 * 9/2002 Carmichael et al. ..... 166/177.3
6,607,607 B1 * 8/2003 Walker et al. ..... 134/18
6,840,315 B1 * 1/2005 Jarchau et al. ..... 166/223

* cited by examiner

*Primary Examiner*—David Bagnell
*Assistant Examiner*—Ngoc Kinney
(74) *Attorney, Agent, or Firm*—John F. Bryan

(57) ABSTRACT

Apparatus connected to the downhole end of a tubing string for cleaning and flushing wells has a threaded connection to the string and at least one primary jet to direct circulating gases toward the downhole end of the well, together with a plurality of secondary jets which are arranged around the exterior of the tubular member and directed upwardly at an acute angle with respect to the longitudinal axis of the tubular member and skewed radially at an acute angle with respect to the surface of the tubular member the skew angle being opposed to the thread angle so as to tend to tighten the threaded connection and the upwardly directed gas volume being approximately one and one-half to four times that which is directed toward the downhole end of the well.

11 Claims, 1 Drawing Sheet

METHOD AND APPARATUS FOR WELL BORE CLEANING

TECHNICAL FIELD

The present invention relates to the cleaning of well bores in oil or gas well workover operations and more particularly, to apparatus wherein jets for liquid or gaseous fluids are directed at the well bore to clean and flush the formation and well casing.

BACKGROUND

The build-up of sand and earthen materials at the well bottom and deposits of paraffin and or asphalt inside the well casing cause persistent problems for producing gas and oil wells. It is necessary to remove these foreign materials periodically to maintain well output. This need has long been present in the oil field, and various prior art well cleaning devices have been offered in response. Prior art devices for cleaning and flushing undesirable materials from a well casing or well bore by fluid flow are well known. In the prior art as well as in the present invention, the general term "fluid" is construed to represent either a liquid or a gaseous medium. In actuality, prior art devices in general are designed to operate with relatively incompressible liquid media, but can work with expansible gaseous media, which behave quite differently from liquids. In all cases, ambient pressure in the hole is the controlling variable. As a point of reference, the bottom hole pressure in a typical oil or gas well may be 3,000 to 4,000 p.s.i. When the operating pressure of the cleaning device significantly exceeds the downhole pressure, circulating fluid will be lost into the surrounding formation.

H. M. Green, U.S. Pat. No. 1,279,333 discloses a well cleaning device comprising a tubular member having a threaded upper end for connection to the pump tubing and a conical lower end to assist in advancing through the well bottom materials as they are removed. Water jets are arranged in a spiral pattern on the tubular member and directed tangentially in order to maintain a vigorous whirling action for sand removal. Green teaches that the lowermost jets are directed downwardly, intermediate jets are directed tangentially and uppermost jets are directed upwardly. Green does not teach the use of upwardly directed jets to create a low pressure zone, nor the application of differential pressure for extraction of entrained solids from a lower level.

F. F. Lewis, U.S. Pat. No. 2,771,141 discloses a well bore cleaning device using upwardly directed jets, which is intended to preform the function of mechanical "scratchers" on the casing exterior. The jets direct a fluid to impinge upon the well bore walls to dislodge filter cake or mud deposits and flush them up the bore. Suitable fluids may include cutting acids or solvents. Lewis does not teach the use of upwardly directed jets to create a low pressure zone above the scouring area with a gaseous medium, nor the application of differential pressure for extraction of entrained solids from a lower level of the well.

D. Robichaux, U.S. Pat. No. 3,912,173 discloses a formation flushing tool having plurality of longitudinally connected sections, each section with jetting holes for a fluid such as water pointed in a particular direction unique to that section. In the disclosed embodiment, the jets are directed downward in the lower section, horizontally outward in the intermediate section, and upward in the top section. The tubing inside diameter is reduced successively from each section down to the next, so that a suitably sized plug may be dropped in to shut off fluid flow at a selected level. In this manner, only those jets above the plug are selected to be active. Robichaux does not teach the use of upwardly directed jets to create a low pressure zone above the scouring area with a gaseous medium, nor the application of differential pressure for extraction of entrained solids from a lower level of the well.

A first object of the present inventions is therefore, to provide apparatus for cleaning and flushing wells, which is specifically adapted to utilize gases and take advantage of the expansible nature of gases for lifting materials in the annulus. A second object is to accomplish this in apparatus that can clean efficiently at operating pressures not greatly in excess of the bottom hole well pressure. A third object is to accomplish this in apparatus that is durable and not susceptible to damage. Yet another object is to provide this apparatus in a form that can be used in either rotating or non-rotating strings.

SUMMARY OF THE INVENTION

The present inventions contemplate improved methods and apparatus for cleaning and flushing wells. These inventions relate to or employ some steps and apparatus well known in the oil field arts and therefore, not the subject of detailed discussion herein.

The present inventions divide a gaseous downhole flow into discreet volumes, the first to flow through a primary jet, for scouring unwanted material from below the tool, and the second to a plurality of secondary jets, for lifting the unwanted material to the surface. These discreet volumes interact, in a synergistic and heretofore unobvious manner, to address the above objectives. A preferred embodiment of the present inventions comprises a hollow member, connected by an axial thread to the downhole end of the string. At least one primary jet orifice is oriented in a downward direction at the lower end of the hollow member, so as to be directed toward the well bottom. A plurality of secondary jet orifices are arranged around the exterior of the tubular member, directed upwardly at an acute angle relative to the longitudinal axis of the hollow member and skewed at an angle opposed to the axial thread direction, so that the tendency is to tighten the threaded connections. The cleaning medium, which may be natural gas, inert gas, foam or a combination of a gas, such as nitrogen, and water, is pressurized at the surface and conducted downhole to the apparatus of the present inventions by jointed pipe or coiled tubing. Gases exiting the downwardly directed primary jet or jets at the lower end of the apparatus loosen, separate, agitate and entrain materials from the tubing or casing, so that these materials are displaced upwardly into the annulus.

The kinetic energy of flow through the axially orientated primary jet dislodges the material to be removed and is dissipated as the direction of flow reverses into the annulus between the tool and the well casing. The flow reversal and resulting turbulence maintain a relatively high back pressure around the primary jet. As the flow rises in the annulus, the turbulence fades and consequently, the pressure drops. The back pressure will increase as primary jet volume increases, even to the point of forcing gas and fluid out into the formation. Experimentation with the present inventions using rotating and non-rotating primary jets has shown that a rotating jet is more effective in dislodging and mobilizing materials at operating pressures not greatly in excess of the bottom hole well pressure. Thus, the present inventions may use a type of commercially available rotating jet that is well known to those skilled in the art. Primary jets of this type are bearing mounted to provide for axial rotation. This rotation is usually powered by an inclined vane in the flow path. Gases exiting the upwardly directed, secondary jets create a low pressure zone above the entrained materials by Bernoulli effect. This low pressure expands the primary jet gases and entrained debris as the are pulled upwardly into the annulus.

Bottom hole pressure may vary and the differential diameter of the casing and cleaning apparatus changes from one job to the next. In order to be useful in the field, the tool must be adaptable to a wide range of working conditions. In most oil and gas wells, the tool must pass through internal diameters of 2" and be capable of working effectively in casings having an internal diameter of 9" or more. When the annulus area is greater, the primary jet fluid flow rate must also be greater, in order to dislodge and mobilize material across the increased area. At the same time, the secondary jet flow rate must be increased to maintain the aforementioned low pressure zone. The upward flows combine in the annulus to overcome the fall-back rate of the entrained debris. Therefore, the apparatus of the present inventions can accommodate a wide range of annulus dimensions by making appropriate changes to the total flow rate.

Different jet placements and flow rate differentials were tested to determine the affect of these changes on the quantity and density of sand slurry lifted in the annulus. In this manner, it has been determined that this apparatus is most effective when the secondary jet volume is in the range of from one and one-half to four times greater than the primary jet volume. The secondary jet Bernoulli effect varies with annulus area and flow rate but, in mid-range, a negative relative pressure of 10 p.s.i. or more can be maintained.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
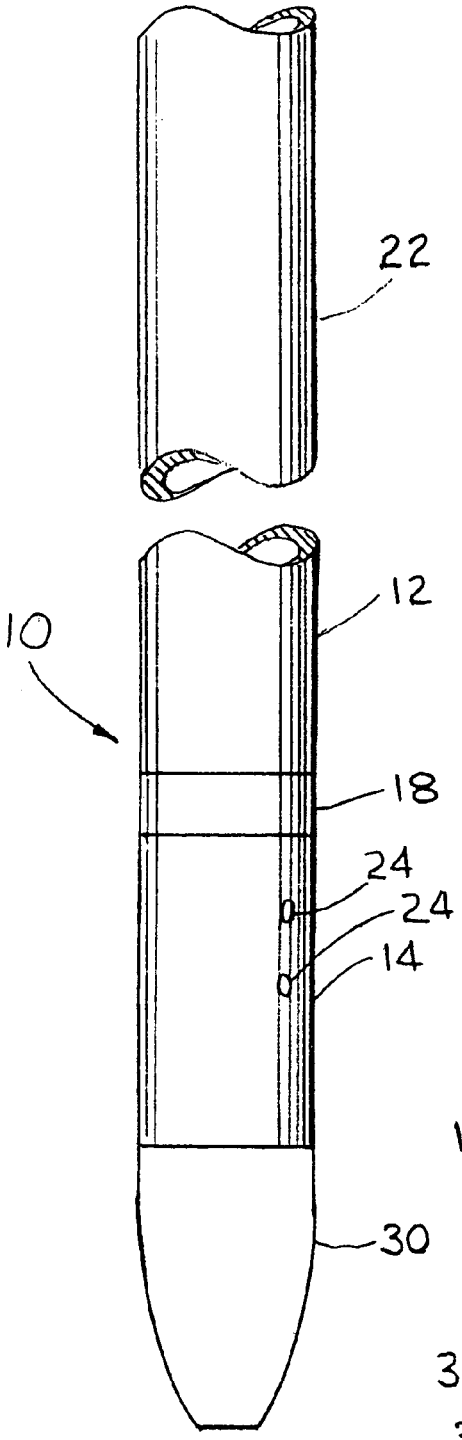
FIG. 1 is a elevation view of a preferred embodiment of a well casing cleanout and flushing device incorporating the present inventions.

The present inventions are described in the following by referring to drawings of examples of how the inventions can be made and used. In these drawings, reference characters are used throughout the views to indicate like or corresponding parts. The embodiments shown and described herein are exemplary. Many details are well known in the art, and as such are neither shown nor described.

Figure 2:
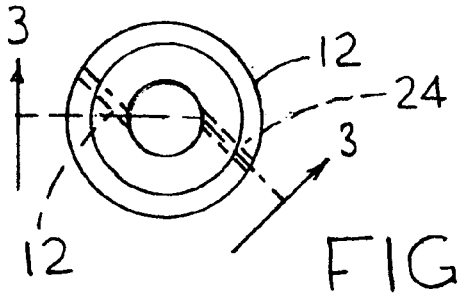
FIG. 2 is a top end view of the embodiment of FIG. 1 showing the hidden secondary jets.
Figure 3:
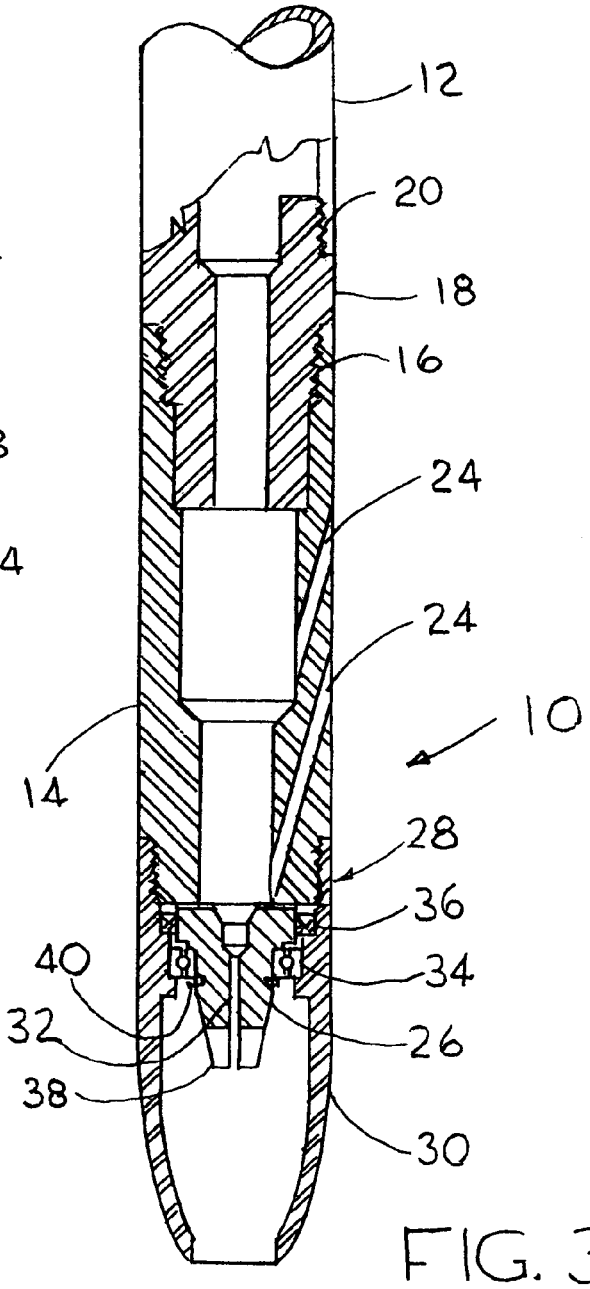
FIG. 3 is a cross-section view of the embodiment of FIG. 1 as seen along plane 3—3 of FIG. 2.

FIGS. 1, 2 and 3 show a preferred embodiment of casing cleanout tool 10 as it is connected to hollow tubular carrier 12, which extends to the surface. Cylindrical tool body 14 is connected by threaded connection 16 to adapter 18, connecting in turn, by threaded connection 20, to carrier tube bottom end 12 of tubing string 22. Tubing string 22 extends to the surface to conduct circulating fluid flow to tool body 14. Tool body 14 includes a plurality of upwardly aimed, secondary jet orifices 24, angled at an acute angle such as twenty degrees from the longitudinal tool axis. Orifices 24 are also skewed at an angle with respect to the radius of the cylindrical tool surface, so that the gaseous fluid flow will have a swirling action and so that reaction thrust will tend to tighten threaded connections 16 and 20. Downwardly directed jet body 26, with primary jet orifice 32, is centrally mounted for rotation on bearing 34 at the lower end of tool body 14, where it is retained by snap ring 40 and threaded connection 28 of shroud 30. Seal 36 prevents leakage between jet body 26 and shroud 30. Expansion of primary jet fluid flow acts on inclined vanes 38 to drive rotation of primary jet body 26. Open ended shroud 30 covers and protects primary jet 26 and vanes 38 from contact with bottom hole and damage from material blow back. In other preferred embodiments, rotation may be induced by a spiral internal jet liner or by having one or more primary jets spaced apart from the longitudinal axis of the jet body and slightly inclined so as to cause the primary jet body to rotate.

Secondary jet orifices 24 are of a size and number so that their aggregate cross-sectional area is at least one and one-half times, but not more than four times, the cross-sectional area of primary jet orifice (or orifices) 32. This range of volumetric ratios provides the synergism which characterizes the performance of the present inventions The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

We claim:

1. Apparatus connected to the downhole end of a tubing string for cleaning and flushing wells comprising:

a hollow tubular member having first and second ends, the first end threaded for connection to the tubing string;

at least one primary jet orifice, leading from the tubular member interior at the second end and directed toward the bottom of the well;

an open ended shroud covering and protecting the primary jet; and a plurality of secondary jet orifices arranged around the exterior of the tubular member, leading from the tubular member interior and directed upwardly at an acute angle with respect to the longitudinal axis of the tubular member and skewed radially at an angle with respect to a radius of the tubular member surface, wherein the aggregate cross-sectional area of the secondary jet orifices is at least one and one-half times, but not more than four times, the aggregate cross-sectional area of the at least one primary jet orifice.

2. The apparatus of claim 1 wherein the secondary jets are skewed at an angle opposed to the thread direction, so that jet reaction forces tend to tighten the threaded connection.

3. The apparatus of claim 1 wherein the primary jet is mounted for rotation with respect to the hollow tubular member.

4. The apparatus of claim 3 wherein the primary jet is driven to rotate by the fluid flow therethrough.

5. The apparatus of claim 3 wherein the primary jet is driven to rotate by fluid flow contacting inclined vanes.

6. The apparatus of claim 3 wherein the primary jet is driven to rotate by fluid flow through one or more inclined orifices.

7. A method for cleaning and flushing wells comprising the steps of:

connecting a tubing string to a pressurized fluid source at the ground surface;

running the string downhole;

loosening and agitating undesirable material below the downhole end of the string with a primary flow of downwardly directed fluid;

covering and protecting the primary jet with an open ended shroud;

entraining and pulling the undesirable materials upward with a low pressure zone created above the primary flow source by an upwardly directed secondary gaseous flow, one and one-half to four times greater than the primary flow; and carrying the entrained materials to the surface with the combined primary and secondary fluid flows.

8. The method of claim 7 and further comprising the step of rotating the downwardly directed primary jet flow.

9. The method of claim 7 wherein the fluid flow is gaseous in nature.

10. The method of claim 7 wherein the fluid flow is liquid in nature.

11. The method of claim 7 wherein the fluid flow is of a gaseous liquid nature.

* * * * *